US007530125B2

(12) United States Patent
Neuenswander

(10) Patent No.: US 7,530,125 B2
(45) Date of Patent: May 12, 2009

(54) ADJUSTABLE BED HAVING MOVABLE FRAME

(75) Inventor: Jacob J. Neuenswander, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 96 days.

(21) Appl. No.: 11/779,602

(22) Filed: Jul. 18, 2007

(65) Prior Publication Data

US 2009/0019640 A1 Jan. 22, 2009

(51) Int. Cl.
*A47B 7/02* (2006.01)

(52) U.S. Cl. ..... 5/616

(58) Field of Classification Search ..... 5/600, 5/613, 616, 618, 619, 915
See application file for complete search history.

(56) References Cited

U.S. PATENT DOCUMENTS

| | | | | | |
|---|---|---|---|---|---|
| 4,385,410 | A | | 5/1983 | Elliott et al. | |
| 4,535,492 | A | * | 8/1985 | Sebest | 5/616 |
| 4,559,655 | A | | 12/1985 | Peck | |
| 5,063,623 | A | * | 11/1991 | Bathrick et al. | 5/616 |
| 5,245,718 | A | | 9/1993 | Krauska | |
| 5,640,730 | A | | 6/1997 | Godette | |
| 6,006,379 | A | | 12/1999 | Hensley | |
| 6,163,904 | A | * | 12/2000 | Royston | 5/618 |
| 6,276,011 | B1 | | 8/2001 | Antinori | |
| 6,393,641 | B1 | | 5/2002 | Hensley | |
| 6,499,161 | B1 | | 12/2002 | Godette | |
| 6,499,162 | B1 | | 12/2002 | Lu | |
| 6,640,365 | B1 | | 11/2003 | Chang | |
| 6,880,189 | B2 | * | 4/2005 | Welling et al. | 5/618 |
| 7,036,165 | B2 | * | 5/2006 | Weinman et al. | 5/617 |
| 7,093,312 | B2 | | 8/2006 | Mossbeck | |
| 7,134,156 | B2 | | 11/2006 | Mossbeck | |
| 2002/0078503 | A1 | * | 6/2002 | Godette | 5/600 |
| 2004/0103476 | A1 | | 6/2004 | Barcesat | |

* cited by examiner

*Primary Examiner*—Patricia L Engle
*Assistant Examiner*—Gilbert Y Lee
(74) *Attorney, Agent, or Firm*—Wood, Herron & Evans, LLP

(57) ABSTRACT

An adjustable bed includes a stationary base having side rails with channels. A frame movable relative to the base has rollers which ride in these channels. An articulated deck comprising head, seat, leg and foot deck boards hingedly joined together is supported by the frame when horizontal. A plurality of links pivotally secured to brackets secured to the head and leg deck boards and pivotally secured to the base limit travel of the head and leg deck boards. Additional links pivotally secured to brackets secured to the foot deck board and to the movable frame limit movement of the foot deck board. An actuator assembly is operatively coupled to the frame and includes a linear actuator. Activation of the actuator inclines the deck boards.

26 Claims, 3 Drawing Sheets

ADJUSTABLE BED HAVING MOVABLE FRAME

FIELD OF THE INVENTION

This invention relates generally to adjustable beds and, more particularly, to an adjustable bed having a linear actuator assembly for moving the deck of the bed.

BACKGROUND OF THE INVENTION

A well known type of bedding product comprises a motorized adjustable bed in which an articulated frame supports a mattress. These motorized adjustable beds have traditionally been used in hospitals but more and more are being installed and used in residential homes. Motorized articulated beds have conventionally had an upper body support movable between an inclined position in which it supports the patient in a sitting position and a prone position in which the patient lies down in a generally horizontal position. In addition, a leg support is movable between positions and may be adjusted to a desired degree of inclination. An actuating mechanism, commonly two or more electric motors, raises and lowers the head and leg supports of the articulated bed frame. U.S. Pat. No. 5,640,730 discloses such an articulated bed. Disadvantages of adjustable beds incorporating two electric motors over adjustable beds having only one electric motor include 1) the odds of at least one of the motors malfunctioning increases and 2) increased manufacturing costs.

In order to reduce the manufacturing costs of an adjustable bed, adjustable beds have been made with a single motor. U.S. Pat. Nos. 4,385,410 and 4,559,655 discloses such adjustable beds powered by a single motor. Some known adjustable beds powered by a single motor require a great deal of power to raise and lower the bed sections to their desired positions due to the weight of the person lying on the bed.

U.S. Pat. Nos. 6,499,162 and 6,640,365 disclose adjustable beds comprising a plurality of bedplates pivotally secured together for supporting a mattress. Connecting elements or links pivotally connect a base to the bed plates. A movable member slides along the base and is activated by a piston movable from inside a cylinder secured to the base. Activation of a power source such as an electric motor causes movement of the bed plates via movement of the sliding member. One disadvantage with such adjustable beds is that the slidable member may be jammed or trapped and unable to slide along the base. If this occurs, activation of the piston may damage or break one or more of the elements of the adjustable bed.

Therefore, there is a need for an improved articulated bed powered by a linear actuator which moves a frame above a stationary base using rollers.

SUMMARY OF THE INVENTION

This invention comprises an adjustable bed having an adjustable deck for supporting a mattress. The adjustable bed is preferably powered by a motorized linear actuator. However, any other drive assembly such as a solenoid may be used in accordance with the present invention.

The adjustable bed comprises a generally rectangular stationary base comprising a pair of opposed side rails, a head end rail and a foot end rail located at the head and foot ends of the adjustable bed, respectively. Supports extending downwardly from the head and foot end rails support the base a fixed distance above the floor or supporting surface. Although legs are preferable, other types of supports may be used to raise and/or maintain the stationary base above the supporting surface.

Each of the side rails of the base has a channel built therein. More particularly, each of the side rails of the stationary base has a "C-shaped" cross-sectional configuration which defines the channel.

The adjustable bed further comprises a frame spaced above the stationary base and movable relative to the stationary base. The frame includes a pair of side assemblies joined by transversely extending cross members. Each of the side assemblies of the frame comprises a generally "L-shaped" member comprising a vertically oriented leg portion and a horizontally oriented side portion. A support leg is secured to the horizontally oriented side portion of the generally "L-shaped" member so each side assemblies has two legs. In combination, each side assembly of the movable frame has two legs, each having a roller rotatably secured to the leg at the bottom thereof which travels or moves in one of the channels of one of the side rails of the stationary base.

The adjustable bed further comprises an articulated deck for supporting a mattress or similar product. The articulated deck comprises a head deck board, a seat deck board fixedly secured to the frame, a leg deck board and a foot deck board hingedly joined to each other. The articulated deck is movable between a horizontal position in which all of the deck boards are horizontal and coplanar and a fully inclined position in which the head, leg and foot boards are inclined and the seat deck board remains in its horizontal position and fixed to the movable frame.

The adjustable bed further comprises a pair of head links. Each head link is of a fixed length and is pivotally secured to one of the side rails of the stationary base at one end and pivotally secured to a bracket fixedly secured to the head deck board at its other end. These head links connect the base and the head deck board.

Similarly, a pair of leg links connect the base to the leg deck board. Each leg link is of a fixed length and is pivotally secured to one of the side rails of the stationary base at one end and pivotally secured to a bracket fixedly secured to the leg deck board at its other end.

A pair of foot links connect the movable frame to the foot deck board. Each foot link is of a fixed length and is pivotally secured to one of the side rails of the movable frame at one end and pivotally secured to a bracket fixedly secured to the foot deck board at its other end.

A motorized actuator assembly is operatively coupled to the movable frame of the adjustable bed. The motorized actuator assembly functions to move the articulated deck between a first horizontal position in which all of the deck boards are co-planar in a horizontal position and a second fully inclined position in which the head deck board is inclined, the seat deck board generally horizontal, the leg and foot deck boards inclined.

The motorized actuator assembly comprises a cylinder secured to one of the cross members of the frame, a piston movable relative to the cylinder, the piston being operatively coupled to a pair of link arms of a fixed length operatively coupled to a torque tube. A pair of operating arms are welded or otherwise secured to the torque tube, each of the operating arms having a roller at the end thereof for engaging the head deck board of the articulated deck and raising the head deck board. The linear actuator of the actuator assembly is powered by an electric motor. Activation of the electric motor extends the piston relative to the cylinder which causes the torque tube to rotate which causes the operating arms to contact and raise the head deck board from its first horizontal position to its second inclined position.

In operation, starting from the first position of the articulated bed in which the articulated deck is generally horizontal, an operator activates the motorized actuator assembly in any known manner. The electric motor extends the piston relative to the cylinder which rotates the torque tube which causes the operating arms of the actuator assembly to rotate or pivot about a horizontal axis. Movement of the operating arms causes the operating arms to contact the head deck board to move the head deck board from its first horizontal position to its second inclined position. As the head deck board inclines, the seat deck board moves horizontally towards the head end of the bed with the frame in what is known in the industry as a wall hugger motion. As the seat deck board moves towards the head end of the bed, the leg deck board moves from its first horizontal position to its second inclined position. This movement of the leg deck board causes the foot deck board to incline, its foot edge moving towards the head end of the bed as the foot links pivot about horizontal pivot axes.

The configuration of the articulated bed of the present invention allows a user to move an upper frame of the articulated bed relative to a stationary base using rollers traveling in channels in the base. The articulated bed enables the deck to move between a first horizontal or prone position to a second inclined position with the assistance of the motorized actuator assembly of the articulated bed.

These and other objects and advantages of the present invention will be more readily apparent from the following drawings.

DETAILED DESCRIPTION OF THE DRAWINGS

Figure 1:
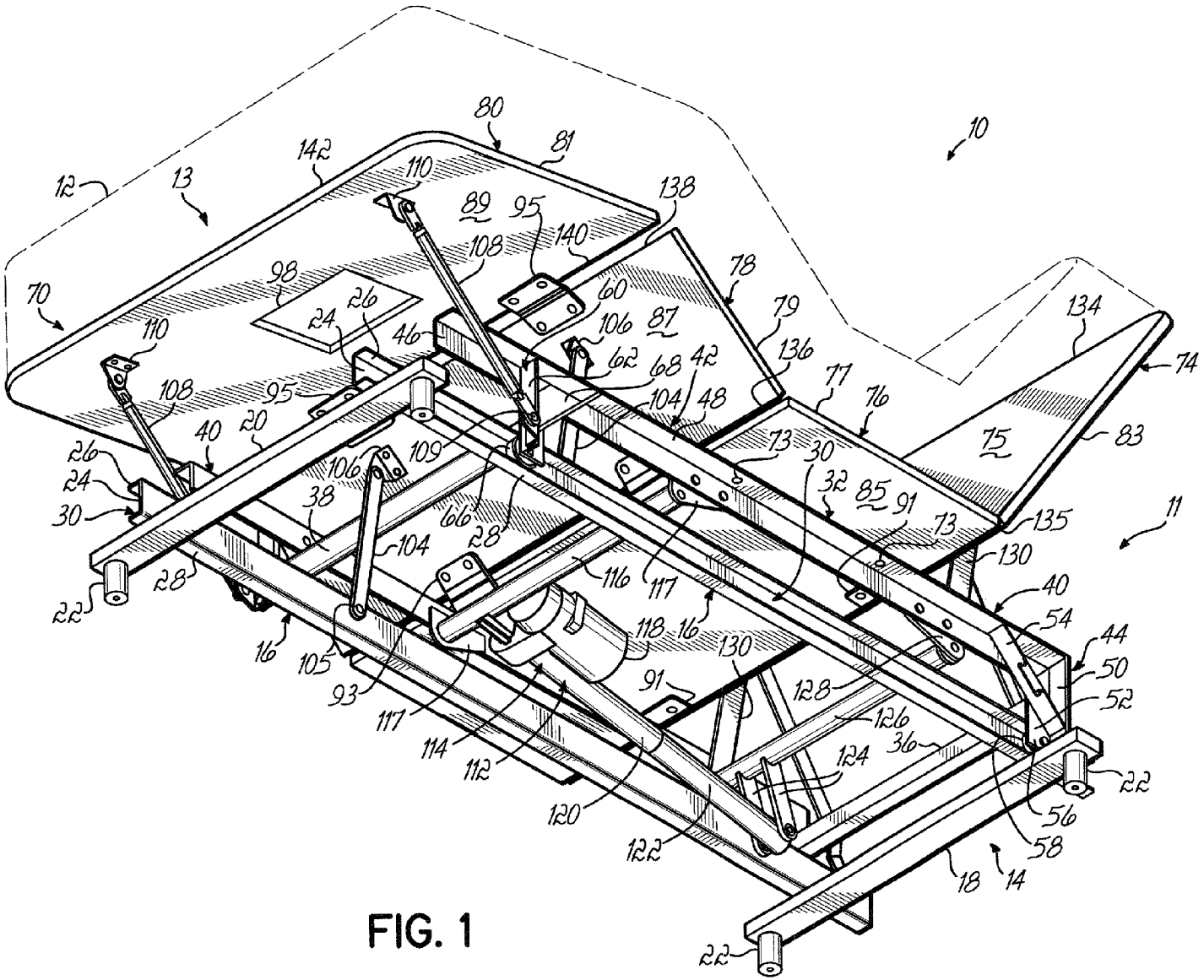
FIG. 1 is a bottom perspective view of an adjustable bed made in accordance with this invention in a fully inclined position supporting a mattress shown in phantom.

Referring to the drawings, and particularly to FIG. 1, there is illustrated an adjustable bed 10 including a mattress 12. The adjustable bed 10 may be used to support any type of mattress including an air mattress, a coil spring mattress or any other type of mattress. The mattress 12 does not form a part of the present invention.

Figure 2:
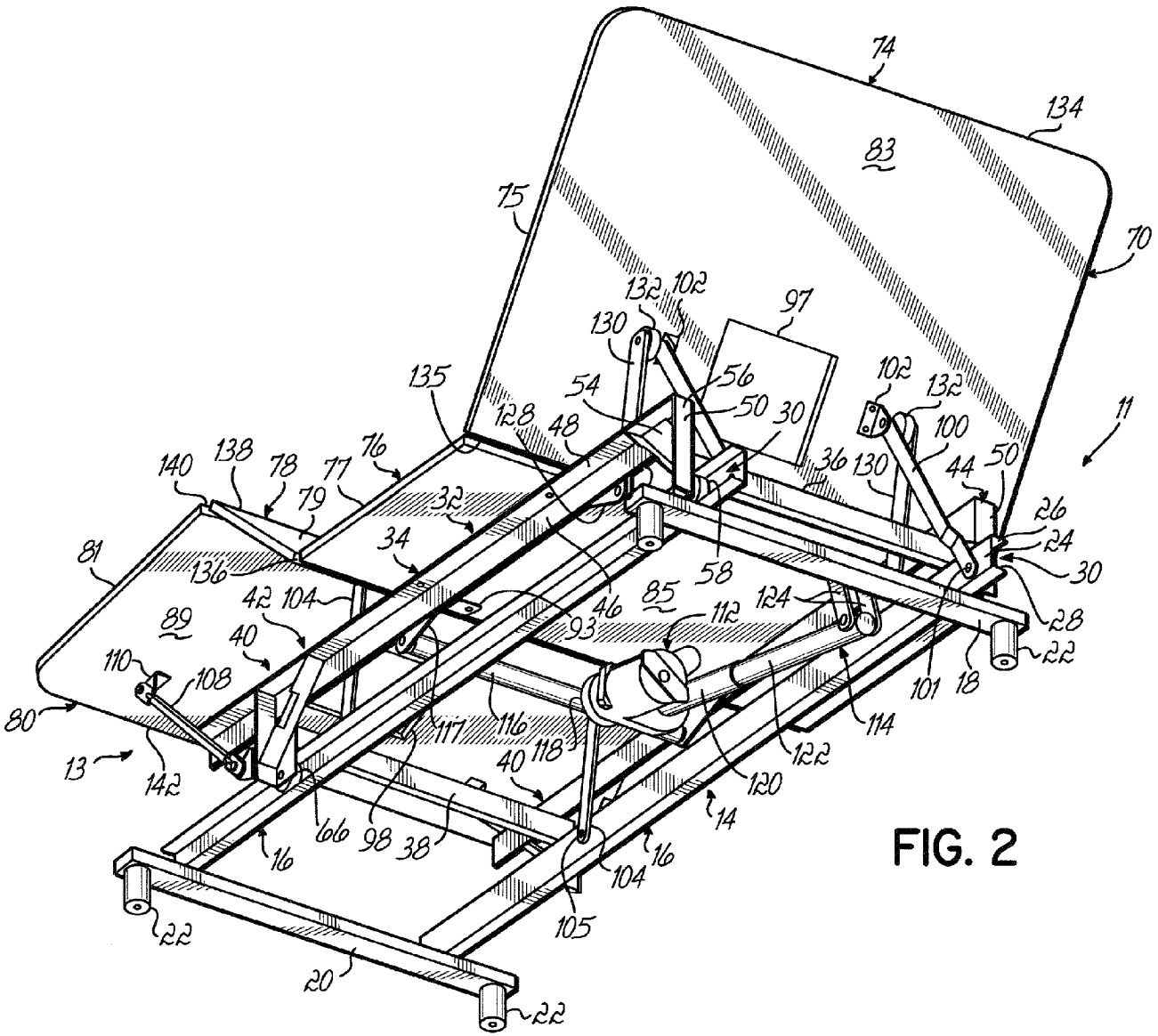
FIG. 2 is another bottom perspective view of the adjustable bed of FIG. 1 without the mattress in a fully inclined position.
Figure 3:
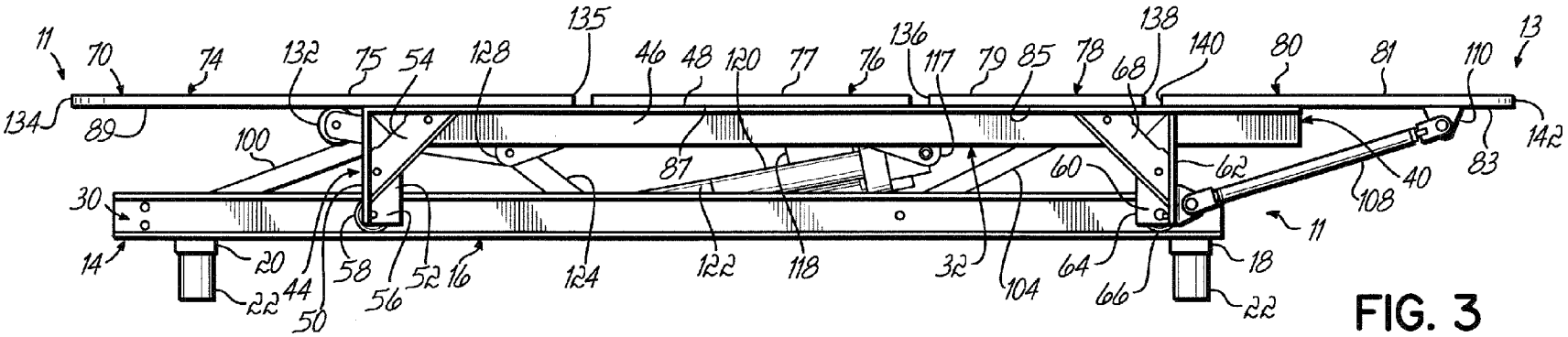
FIG. 3 is a side elevational view of the adjustable bed of FIG. 1 without the mattress in a horizontal position.
Figure 4:
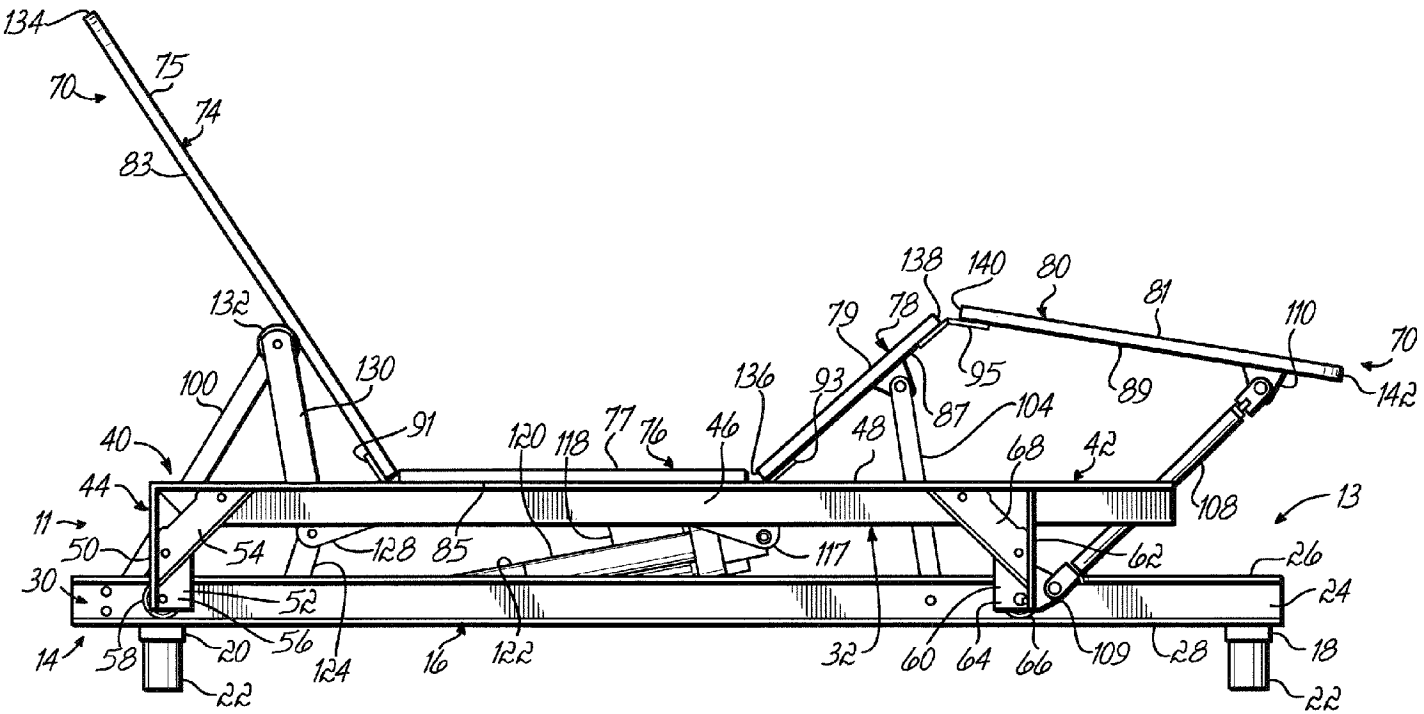
FIG. 4 is a side elevational view of the adjustable bed of FIG. 1 without the mattress in a fully inclined position.

The adjustable bed 10 has a head end 11 and a foot end 13. The adjustable bed 10 is movable between a first horizontal position shown in FIG. 3 and a fully inclined position as shown in FIGS. 1, 2 and 4. Typically, an operator or user sleeps with the adjustable bed in its first horizontal position and reads or watches television with the adjustable bed in its fully inclined position. However, the adjustable bed 10 may assume any intermediate position between the extreme positions illustrated and maintained in such a position.

The adjustable bed 10 comprises a stationary generally rectangular base 14 comprising a pair of opposed side rails 16, a head end rail 18, a foot end rail 20 and four legs 22 supporting the base 14 a fixed distance about a floor or supporting surface (not shown). The head and foot end rails 18, 20, respectively, each are secured to each side rail 16 and extend therebetween. The head and foot end rails 18, 20, respectively, are illustrated being rectangular in cross-section. However, they may be any desired size or shape, hollow or solid. The legs 22 are shown secured and extending downwardly from the head and foot end rails 18, 20, respectively, but may be secured to the side rails 16 if desired. Although a cylindrical shaped leg 22 is illustrated, any configuration or length of leg or similar support may be used.

As shown in FIG. 1, each of the side rails 16 of the base 14 has a generally C-shaped cross-sectional configuration including a vertically oriented side portion 24, a horizontally oriented top portion 26 extending outwardly from the upper edge of the side portion 24 and a horizontally oriented bottom portion 28 extending outwardly from the lower edge of the side portion 24. The side, top and bottom portions, 24, 26 and 28, respectively, define an outwardly facing channel 30 in each side rail 16 of the base 14. Although each side rail 16 is illustrated having a generally C-shaped cross-sectional configuration along its entire length, any desired configuration or length of side rail may be used in the base. For example, the channels may be shaped differently than those illustrated.

The adjustable bed 10 further comprises a frame 32 movable relative to the stationary base 14. The frame 32 is movable between a first position shown in FIG. 3 when the adjustable bed 10 is in its first horizontal position and a second position shown in FIGS. 1, 2 and 4 when the adjustable bed 10 is in its fully inclined position as shown in FIGS. 1, 2 and 4. In its first position shown in FIG. 3, the frame 32 is located proximate the head end 11 of the bed (to the right as shown in FIG. 3). In its second position shown in FIG. 4, the frame 32 is located proximate the foot end 13 of the bed (to the left as shown in FIG. 4).

As shown in the drawings, the movable frame 32 comprises a pair of side assemblies 34 connected by front and rear cross members 36, 38, respectively. Each of the front and rear cross members 36, 38, respectively, are joined to each side assembly 34 and extends therebetween. The front and rear cross members 36, 38, respectively, of the movable frame 32 are illustrated being rectangular in cross-section. However, they may be any desired size or shape, hollow or solid.

Each of the side assemblies 34 of the movable frame 32 comprises a generally "L-shaped" member 40 having a horizontal portion 42 and a vertical leg portion 44 at the head end 11 of the adjustable bed 10 extending downwardly from the horizontal portion 42 of the generally "L-shaped" member 40. The horizontal portion 42 has a vertical flange 46 and a horizontal flange 48 while the vertical leg portion 44 has a first flange 50, a continuation of the horizontal flange 48 and a second flange 52, a continuation of the vertical flange 46. Thus, each portion 42, 44 of each generally "L-shaped" member 40 has an "L-shaped" cross sectional configuration.

A front brace 54 extends between the horizontal portion 42 and the vertical leg portion 44 of the generally "L-shaped" member 40. The brace 54 is riveted, welded or otherwise secured to the vertical flange 46 of the horizontal portion 42 and the second flange 52 of the leg portion 44 of the generally "L-shaped" member 40. Although one configuration of front brace 54 is illustrated, other configurations or styles of braces may be used.

For purposes of this document, the vertical leg portion 44 of each generally "L-shaped" member 40 of the movable frame 32 may be referred to as a front leg 56 which has a front roller 58 rotatably secured at the bottom thereof, each front roller 58 being sized and adapted to travel inside the channel 30 of one of the side rails 16 of the stationary base 14. The front roller 58 is rotatably secured to the second flange 52 of the front leg 56.

Each of the side assemblies 34 further comprises a support or rear leg 60 having a first flange 62 and a second flange 64 at right angles or orthogonal to each other. Thus, the support or rear leg 60 has a cross sectional configuration which is generally "L-shaped." The first flange 62 of the rear leg 60 is parallel the first flange 50 of the front leg 56 while the second flange 64 of the rear leg 60 is parallel the second flange 52 of the front leg 56. A rear roller 66 is rotatably secured to the second flange 64 of the rear leg 60 of each side assembly 34 of the movable frame 32. Each rear roller 66 is sized and adapted to travel inside the channel 30 of one of the side rails 16 of the stationary base 14.

A rear brace 68 extends between the horizontal portion 42 of the generally "L-shaped" member 40 and the rear leg 60. The rear brace 68 is riveted, welded or otherwise secured to the vertical flange 46 of the horizontal portion 42 of the generally "L-shaped" member 40 and the second flange 64 of the rear leg 60 of each side assembly 34. Although one configuration of rear brace 68 is illustrated, other braces may be used.

Portions of an articulated deck 70 are operatively coupled to the movable frame 32 with a plurality of connectors 72 and a portion of the articulated deck 70 is operatively coupled to the movable frame 32 with fasteners 73. The articulated deck 70 comprises a head deck board 74, a seat deck board 76, a leg deck board 78 and a foot deck board 80. Each of the deck boards is preferably the same width but any two deck boards may be different widths, if desired. Deck boards 74, 76, 78 and 80 have upper surfaces 75, 77, 79 and 81, respectively, and lower surfaces 83, 85, 87 and 89, respectively.

As best illustrated in FIGS. 1 and 2, the head deck board 74 is hingedly secured to the seat deck board 76 with hinges 91 secured to the lower surfaces 83, 85 of the head and seat deck boards 74, 76, respectively. Similarly, seat deck board 76 is hingedly secured to leg deck board 78 with hinges 93 secured to the lower surfaces 85, 87 of the seat and leg deck boards 76,78, respectively. Leg deck board 78 is hingedly secured to foot deck board 80 with hinges 95 secured to the lower surfaces 87, 89 of the leg and foot deck boards 78, 80, respectively. Although, two hinges 91 are shown in FIGS. 1 and 4 securing the head deck board 74 to the seat deck board 76, any number of hinges may be used including one continuous hinge. The same applies to hinges 93 and 95 connecting the other deck boards.

The deck boards 74, 76, 78 and 80 are preferably made of plywood, but may be made of plastic, oriented strand board or any other material.

As illustrated in FIG. 2, the head deck board 74 has a rectangular hole 97 therein which may be used to mount a massage unit (not shown) as is common in the industry. Similarly, as illustrated in FIG. 1, the foot deck board 80 has a rectangular hole 98 therein which may be used to mount a massage unit (not shown) as is common in the industry.

As illustrated in FIG. 1, the seat deck board 76 is fixedly secured to the movable frame 32 with fasteners 73. More particularly, the fasteners 73 pass through holes in the horizontal flange 48 of the horizontal portion 42 of each side assembly 34 of the movable frame 32 and into the material of the seat deck board 76. Thus, the seat deck board 76 remains flat and fixed in the same location relative to the movable frame 32. When the movable frame 32 moves, the seat deck board 76 moves with it.

The adjustable bed 10 further comprises connectors 72 in the form of links of fixed length which limit the travel of the movable frame 32 relative to the stationary base 14 and limit the movement of the articulated deck 70. As shown in the drawings, the adjustable bed 10 has two head links 100 each of the same fixed length and each pivotally secured at its lower end to one of the side rails 16 of the stationary base 14 with a fastener 101 so that each pivots about a horizontal pivot axis. See FIG. 2. At its upper end each of head links 100 is pivotally secured to a bracket 102 fixedly secured to the lower surface 83 of the head deck board 74. Each head link 100 also pivots about a horizontal axis.

Similarly, two leg links 104 or connectors, each of the same fixed length, are each pivotally secured at a lower end to one of the side rails 16 of the stationary base 14 with a fastener 105 so that each pivots about a horizontal pivot axis. See FIG. 1. Each leg link 104 is pivotally secured at its upper end to a bracket 106 fixed to the lower surface 87 of the leg deck board 78 and also pivots about a horizontal axis.

As illustrated in FIGS. 1, 3 and 4, two foot links 108 or connectors, each of the same fixed length, are each pivotally secured at a lower end to one of the rear legs 60 of the side assemblies 34 of the movable frame 32 with fastener 109 so that each pivots about a horizontal pivot axis. See FIG. 1. Each foot link 108 is pivotally secured at its upper end to a bracket 110 fixed to the lower surface 89 of the foot deck board 80.

The articulated deck 70 is moved by a motorized linear actuator assembly 112 between a first position shown in FIG. 3 in which the deck boards 74, 76, 78 and 80 are generally co-planar in a horizontal position or orientation and a second position shown in FIGS. 1,2 and 4. In the second position, the head deck board 74 is inclined, the seat deck board 76 is substantially horizontal and fixed to the movable frame 32, the leg deck board 76 inclined and the foot deck board 80 slightly inclined.

The motorized linear actuator assembly 112 is mounted to the movable frame 32 and moves with the movable frame 32 relative to the stationary base 14. The motorized linear actuator assembly 112 comprises a motorized linear actuator 114 fixedly secured to a mounting cross member 116 of the movable frame 32 in any known manner. This mounting cross member 116 forms part of the movable frame 32 and is secured to and extends between two brackets 117. Each bracket 117 is secured to a vertical flange 46 of the horizontal portion 42 of one of the generally L-shaped members 40 of one of the side assemblies 34 of the movable frame 32. Thus, the motorized linear actuator 114 moves with the movable frame 32 because it is mounted to the mounting cross member 116 which forms part of the movable frame 32.

The motorized linear actuator 114 comprises an AC motor 118, a cylinder 120 and a piston 122 extendable from inside the cylinder 120. The motorized linear actuator assembly 112 further comprises a pair of spaced link arms 124 (see FIG. 1), each being a fixed length. Each link arm 124 is welded or secured at its upper end to a rotatably torque tube 126 and pivotally secured to the piston 122 of the motorized linear actuator 114 as shown in FIG. 1. The torque tube 126 is mounted between brackets 128, each bracket 128 being secured to a vertical flange 46 of the horizontal portion 42 of the generally L-shaped member 40 of one of the side assemblies 34 of the movable frame 32. Thus, the torque tube 126 is part of the motorized linear actuator assembly 112 and moves with the movable frame 32. The motorized linear actuator assembly 112 further comprises a pair of spaced operating arms 130, each being a fixed length and having a roller 132 at the end thereof for engaging the lower surface 83 of the head deck board 74. See FIG. 4. Each operating arm 130 is welded or secured to the torque tube 126 at its lower end.

Although any type of linear actuator may be used, one which has proven satisfactory is a motorized linear actuator available from Hubbell Special Products Incorporated of Pleasant Prairie, Wis. sold under Part Number 7011954, Model MC42 1007H.

The output of the electric motor 118 extends the piston 122 which pivots or rotates the torque tube 126 which raises the operating arms 130 and causes the rollers 132 to contact and push upwardly the head deck board 74. The electric motor 118 may be remotely controlled or controlled in any known manner.

In operation, starting from the first position of the articulated bed 10 shown in FIG. 3 in which the articulated deck 70 is generally horizontal, an operator (not shown) activates the motorized linear actuator assembly 112 with or without a remote (not shown). Activation of the electric motor 118 rotates the torque tube 126 which causes the operating arms 130 of the actuator assembly 112 to rotate or pivot about a horizontal axis. The rollers 132 located at the upper ends of the operating arms 130 contact the head deck board 74 and move it from its first horizontal position shown in FIG. 3 to its second fully inclined position shown in FIG. 4 in which the head edge 134 of the head deck board 74 is above the rear edge 135 of the head deck board 74.

As the head deck board 74 inclines, the seat deck board 76 and movable frame 32 move towards the head end 11 of the bed, causing or pulling the leg deck board 78 horizontally towards the head end 11 of the bed. The leg deck board 78 also moves towards the head end of the bed, from its first horizontal position shown in FIG. 3 to its second fully inclined position shown in FIG. 4. In this fully inclined position, the front edge 136 of the leg deck board 78 is lower than the rear edge 138 of the leg deck board 78. This movement of the leg deck board 78 causes or pulls the foot deck board 80 towards the head end 11 of the bed as the connectors 72 and in particular the foot links 108 are pivoted about horizontal pivot axes in a counterclockwise direction as viewed in FIGS. 3 and 4. In its fully inclined position shown in FIG. 4, the front edge 140 of the foot deck board 80 is higher than the rear edge 142 of the foot deck board 80.

As desired, the articulated bed 10 may be moved from its fully inclined position shown in FIG. 4 (in which the front edge 134 of the head deck board 74 is above the rear edge 135 of the head deck board 74) back to its horizontal position shown in FIG. 3 via use of the motorized linear actuator assembly 112. Although I have described one preferred embodiment of the invention, I do not intend to be limited except by the scope of the following claims.

I claim:

1. An adjustable bed comprising:

a stationary base having a pair of opposed side rails, each of said side rails including a channel;

a frame movable relative to said stationary base, said frame including a pair of side assemblies;

rollers rotatably mounted to said side assemblies of said frame and being rotatable in said channels of said side rails of said base;

a seat deck board secured to said movable frame;

a head deck board hingedly secured to said head deck board;

a leg deck board hingedly secured to said seat deck board;

a foot deck board hingedly secured to said leg deck board;

a pair of head links of a fixed length, each of said head links being pivotally secured to one of said side rails of said base at one end and being pivotally secured to rackets secured to said head deck board at the other end;

a pair of foot links of a fixed length, each of said foot links being pivotally secured to said movable frame at one end and being pivotally secured to brackets secured to said foot deck boards at the other end;

a pair of leg links of a fixed length, each of said leg links being pivotally secured to one of said side rails of said base at one end and being pivotally secured to brackets secured to said leg deck board at the other end;

an actuator secured to said frame, said actuator including a cylinder and a piston movable relative to said cylinder, said piston being operatively coupled to a pair of link arms operatively coupled to a torque tube, said torque tube being operatively coupled to a pair of operating arms having rollers at the ends therefor for engaging said head deck board to raise the head board.

2. The adjustable bed of claim 1 wherein said actuator is motorized.

3. The adjustable bed of claim 1 wherein each of said side assemblies of said movable frame has two legs, each leg having a roller of the said rollers at the bottom thereof.

4. The adjustable bed of claim 1 further comprising head and foot end rails extending between said opposed side rails of said base.

5. The adjustable bed of claim 4 further comprising legs extending downwardly from said head and foot end rails.

6. The adjustable bed of claim 1 wherein each of said side assemblies of said frame includes a generally "L-shaped" member and a support leg extending down from a horizontal portion of said generally "L-shaped" member.

7. The adjustable bed of claim 6 wherein said actuator includes an electric motor.

8. The adjustable bed of claim 1 wherein each of said side assemblies of said frame includes stationary tabs and a mounting cross member extending between said stationary tabs, said cylinder of said actuator being secured to said mounting cross member.

9. The adjustable bed of claim 1 wherein activation of said actuator moves said head deck board between an inclined position and a horizontal flat position.

10. The adjustable bed of claim 9 wherein said seat deck board remains in a horizontal position.

11. The adjustable bed of claim 1 wherein at least one of said head and foot deck boards has an opening therein for mounting a message mechanism.

12. The adjustable bed of claim 1 wherein at least one of said deck boards has an opening therein for mounting a message mechanism.

13. The adjustable bed of claim 1 wherein said frame moves relative to said stationary base when said head deck board is inclined.

14. The adjustable bed of claim 1 wherein said leg deck board and said foot deck board each incline when said head deck board is inclined.

15. An adjustable bed comprising:

a stationary base having a pair of opposed side rails, each of said side rails having a channel having a "C-shaped" cross-sectional configuration;

a frame movable relative to said stationary base, said frame including a pair of side assemblies;

rollers rotatably mounted to said side assemblies of said frame and being rotatable in said channels of said side rails of said base;

a seat deck board secured to said frame;

a head deck board hingedly secured to said seat deck board and operatively coupled to said base with links of a fixed length;

a leg deck board hingedly secured to said seat deck board and operatively coupled to said base with links of a fixed length;

a foot deck board hingedly secured to said leg deck board and operatively coupled to said frame with links of a fixed length; and an actuator assembly for moving said head, leg and foot deck boards between a horizontal position and an inclined position and moving said frame relative to said stationary base, wherein said actuator assembly includes a linear actuator including a cylinder secured to said frame and a piston movable relative to said cylinder, said piston being operatively coupled to a pair of link arms operatively coupled to a torque tube, said torque tube being operatively coupled to a pair of operating arms having rollers at the ends therefor for engaging said head deck board to raise the head board.

16. The adjustable bed of claim 15 wherein each of said links extending between said head deck board and said base are pivotally secured to one of said side rails of said stationary base at one end and are pivotally secured to brackets secured to said head deck board at the other end.

17. The adjustable bed of claim 15 wherein each of said links extending between said foot deck board and said movable frame are pivotally secured to said movable frame at one end and are pivotally secured to brackets secured to said foot deck board at the other end.

18. The adjustable bed of claim 15 wherein each of said links extending between said seat deck board and said stationary base are pivotally secured to said stationary base at one end and are pivotally secured to brackets secured to said seat deck board at the other end.

19. The adjustable bed of claim 15 wherein said head, leg and foot deck boards are inclined when said piston is in a fully extended position relative to said cylinder.

20. An adjustable bed comprising:

a stationary base having a pair of opposed side rails, a head end rail and a foot end rail;

a frame spaced above said stationary base and movable relative to said stationary base;

an articulated deck comprising a head deck board, a seat deck board, a leg deck board and a foot deck board hingedly joined to each other, said seat deck board being secured to said frame, head links of a fixed length pivotally secured to said side rails of said base and pivotally secured to brackets secured to said head deck board;

seat links of a fixed length pivotally secured to said side rails of said base and pivotally secured to brackets secured to said seat deck board;

foot links of a fixed length pivotally secured to said frame and pivotally secured to brackets secured to said foot deck board; and an actuator assembly including an actuator operatively coupled to said frame, wherein activation of said actuator causes said frame to move horizontally relative to said stationary base and incline said head, leg and foot deck boards, wherein said actuator assembly further comprises a torque tube extending between opposed side assemblies of said frame and operating arms fixed to said torque tube, wherein activation of said actuator causes rotation of said torque tube and said operating arms to raise said head deck board.

21. The adjustable bed of claim 20 wherein said frame is supported above said stationary base by support legs.

22. The adjustable bed of claim 21 further comprising rollers at the ends of said support legs, said rollers being movable in channels in said side rails of said stationary base.

23. The adjustable bed of claim 20 wherein said actuator assembly is motorized.

24. An adjustable bed comprising:

a stationary base having a pair of opposed side rails;

a frame movable relative to said stationary base, said frame including a pair of side assemblies;

rollers rotatably mounted to said side assemblies of said frame and being rotatable on said side rails of said base;

a seat deck board secured to said movable frame;

a head deck board hingedly secured to said head deck board;

a pair of head links of a fixed length, each of said head links being pivotally secured to one of said side rails of said base at one end and being pivotally secured to brackets secured to said head deck board at the other end;

an actuator secured to said frame, said actuator including a cylinder and a piston movable relative to said cylinder, said piston being operatively coupled to a pair of link arms operatively coupled to a torque tube, said torque tube being operatively coupled to a pair of operating arms having rollers at the ends therefor for engaging said head deck board to raise said head deck board.

25. An adjustable bed comprising:

a stationary base having a pair of opposed side rails;

a frame movable relative to said stationary base, said frame including a pair of side assemblies;

rollers rotatably mounted to said side assemblies of said frame and being rotatable on said side rails of said base;

a seat deck board fixedly secured to said frame;

a head deck board hingedly secured to said seat deck board and operatively coupled to said base with links of a fixed length;

an actuator assembly including a torque tube, said torque tube being operatively coupled to a pair of operating arms having rollers at the ends therefor for engaging said head deck board to raise said head deck board, said actuator assembly, upon activation, moving said head and deck boards between a horizontal position and an inclined position and for moving said frame and attached seat deck board relative to said stationary base.

26. An adjustable bed comprising:

a stationary base having a pair of opposed side rails, a head end rail and a foot end rail;

a frame spaced above said stationary base and movable relative to said stationary base;

an articulated deck comprising a head deck board, a seat deck board, a leg deck board and a foot deck board hingedly joined to each other, said seat deck board being fixedly secured to said frame;

head links of a fixed length pivotally secured to said side rails of said base and pivotally secured to brackets secured to said head deck board;

seat links of a fixed length pivotally secured to said side rails of said base and pivotally secured to brackets secured to said seat deck board;

foot links of a fixed length pivotally secured to said frame and pivotally secured to brackets secured to said foot deck board; and an actuator assembly including an actuator operatively coupled to said frame, wherein activation of said actuator and rotation of a torque tube causes said frame and attached seat deck board to move horizontally relative to said stationary base and incline said head, leg and foot deck boards.

* * * * *

UNITED STATES PATENT AND TRADEMARK OFFICE

CERTIFICATE OF CORRECTION

PATENT NO. : 7,530,125 B2
APPLICATION NO. : 11/779602
DATED : May 12, 2009
INVENTOR(S) : Jacob J. Neuenswander It is certified that error appears in the above-identified patent and that said Letters Patent is hereby corrected as shown below:

Column 1

Line 31, “discloses” should be --disclose--.

Line 56, “IIowever” should be --However--.

Column 2

Line 13, “assemblies” should be --assembly--.

Column 3

Line 56, “and maintained” should be --and be maintained--.

Line 65, “IIowever” should be --However--.

Column 4

Line 31, “are joined” should be --is joined--.

Column 6

Line 47, “rotatably” should be -- rotatable--.

Column 7

Line 52, “secured to said head” should be --secured to said seat--.

Line 58, “rackets” should be --brackets--.

Column 8

Line 36, "message" should be --massage--.

Lines 38-39, "message" should be --massage--.

Column 10

Line 10, "secured to said head" should be --secured to said seat--.

Line 61, "causes" should be --cause--.

Signed and Sealed this

Ninth Day of March, 2010

David J. Kappos

David J. Kappos
*Director of the United States Patent and Trademark Office*